US005986561A

United States Patent [19]

Kuruvilla et al.

[11] Patent Number: 5,986,561

[45] Date of Patent: Nov. 16, 1999

[54] AUTOMATIC DOOR WARNING SYSTEM

[76] Inventors: Kolanparampil K. Kuruvilla; Santhamma Kuruvilla, both of 133A Dawn Dr., Lansdale, Pa. 19446

[21] Appl. No.: 09/093,197

[22] Filed: Jun. 6, 1998

Related U.S. Application Data

[66] Substitute for application No. 08/541,516, Oct. 10, 1995, abandoned.

[51] Int. Cl.[6] ..... G08B 3/00

[52] U.S. Cl. ..... 340/691.5; 340/326; 340/679; 340/691.4; 340/691.6; 340/692; 340/693.5; 340/693.9

[58] Field of Search ..... 340/691.5, 691.4, 340/691.6, 692, 540, 693.5, 693.9, 693.11, 545.1, 679, 326, 331, 332; 49/13; 187/391, 393

[56] References Cited

U.S. PATENT DOCUMENTS

| | | | |
|---|---|---|---|
| 1,709,517 | 4/1929 | Billingsley | 340/654 X |
| 1,790,681 | 2/1931 | Smith | 340/654 X |
| 4,266,221 | 5/1981 | Hawkins | 340/679 |
| 4,400,786 | 8/1983 | Mandel et al. | 364/513 |
| 4,698,937 | 10/1987 | Kornbrekke et al. | 49/25 |
| 4,821,024 | 4/1989 | Bayha | 340/545 |
| 4,832,157 | 5/1989 | Kitano | 187/1 R |
| 4,855,723 | 8/1989 | Fritz et al. | 340/691 |
| 4,967,083 | 10/1990 | Kornbrekke et al. | 250/341 |
| 5,142,152 | 8/1992 | Boiucaner | 250/341 |
| 5,189,388 | 2/1993 | Mosley et al. | 340/309.15 |
| 5,341,123 | 8/1994 | Schuman, Sr. et al. | 340/546 |

FOREIGN PATENT DOCUMENTS

| | | | |
|---|---|---|---|
| 2133191 | 7/1984 | United Kingdom | 340/679 |

*Primary Examiner*—Thomas Mullen
*Attorney, Agent, or Firm*—David L. Volk

[57] ABSTRACT

An apparatus is provided for the automatic advance warning of imminent automatic door closure to passengers of public transportation vehicles. Comprised of a panel mounted above the automatic door, comprising an alarm light, a message display area, and a speaker capable of producing audible alarm warnings as well as audible verbal warning messages, it is capable of warning incoming passengers that automatic door closure is imminent. When a door close signal is received from existing door control circuitry, the apparatus is activated and it produces the audible and visual warning messages. After an appropriate delay period the audible and visual warning devices are deactivated and a door close signal is issued to the existing automatic doors and associated door safety guard circuitry.

7 Claims, 3 Drawing Sheets

AUTOMATIC DOOR WARNING SYSTEM

REFERENCES TO RELATED APPLICATIONS

This application is a substitute of application Ser. No. 08/541,516, filed Oct. 10, 1995, now abandoned.

BACKGROUND OF THE INVENTION

1. Field of the Invention

The present invention relates generally to warning systems and, more particularly, to an automatic door warning system.

2. Description of the Related Art

With the increased use of public transportation in our society, there has been a corresponding increase in accidents that occur to public transportation passengers. Perhaps the most traumatic of these accidents occur when a passenger tries to board a vehicle in which the doors are closing or are about to close and thus becomes trapped. This action often results in bodily injury, trauma, physical disability or even death.

Further compounding this problem is the fact that most forms of public transportation including trains, trams, trolleys, buses, subway trains, and elevators do not have an operator in close physical proximity to the door. This fact often results in an increased response time to door trapped victims increasing injuries and causing mental trauma to fellow passengers.

While most people would never knowingly subject themselves to direct physical harm, sometimes carelessness and a preoccupation with boarding a vehicle leads to distraction from the dangers. Often the first indication a passenger has that a vehicle is about to move is when the vehicle doors begin to close. At this point the passenger must either rapidly move out of the way, perhaps also causing injury, or rely on numerous prior art door safety devices, which may or may not be operational, to avoid injury.

Numerous attempts have been made to correct for the foregoing problems. For instance, U.S. Pat. No. 5,142,152 to Boiucaner discloses a sliding door sensor. This invention controls the operation of sliding doors so that the doors remain in an open position until the pedestrian traffic clears the door threshold. This action would not be acceptable in many situations such as subway trains where a strict schedule must be adhered to. Moreover, this invention does not address the problem of pre-warning the passenger that the doors are about to close.

Several other attempts have been made at providing an automatic door warning system. For example, U.S. Pat. No. 4,967,083 and No. 4,698,937 to Kornbrekke et al. disclose an invention which utilizes multiple sensor modules either mounted above or on the door itself. Once again, any devices made according to either of the Kornbrekke disclosures only provide for the detection of movement within the door threshold or door swing area and do not address the problem of pre-warning the passenger that the doors are about to close.

Finally, U.S. Pat. No. 4,821,024 to Bayha discloses a door operator pre-warning system and proposes solutions which involve an advance warning system. However, the preferred embodiment disclosure in the Bayha reference only addresses the advance warning problem as would be found on a residential overhead garage door and associated radio frequency link and does not address the problem as would be found on various forms of public transportation.

Consequently, a need has been felt for providing an apparatus and method which provides clear and distinct advance warning messages that automatic doors on various forms of public transportation are about to close.

SUMMARY OF THE INVENTION

It is therefore an object of the present invention to provide an improved automatic door warning system.

It is another object of the present invention to provide an automatic door warning system which allows for the visual warning of imminent automatic door closure aboard public transportation vehicles.

It is yet another object of the present invention to provide an automatic door warning system which allows for the audible warning of imminent automatic door closure aboard public transportation vehicles.

It is another object of the present invention to provide an automatic door warning system which allows for retrofitting and ease of installation into existing public transportation vehicles.

It is therefore a feature of the present invention to utilize existing warning light technologies to allow for visual warning of imminent automatic door closure aboard public transportation vehicles.

It is another feature of the present invention to utilize existing message display technologies to allow for visual warning of imminent automatic door closure aboard public transportation vehicles.

It is yet another feature of the present invention to utilize existing audible warning alarm technologies to allow for audible warning of imminent automatic door closure aboard public transportation vehicles.

It is another feature of the present invention to utilize existing electronic voice reproduction technologies to allow for audible warning of imminent automatic door closure aboard public transportation vehicles.

In accordance with a preferred embodiment, an apparatus is provided for the pre-warning of passengers of public transportation vehicles that automatic doors are about to close. Comprised of a panel mounted above the automatic door, comprising an alarm light, a message display area, and a speaker capable of producing audible alarm warnings as well as audible verbal warning messages, it is capable of warning incoming passengers that automatic door closure is imminent. When a door close signal is received from existing door control circuitry, the apparatus is activated and produces the audible and visual warning messages. After an appropriate delay period the audible and visual warning devices are deactivated and a door close signal is issued to the existing automatic doors and associated door safety guard circuitry.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION

Figure 1:
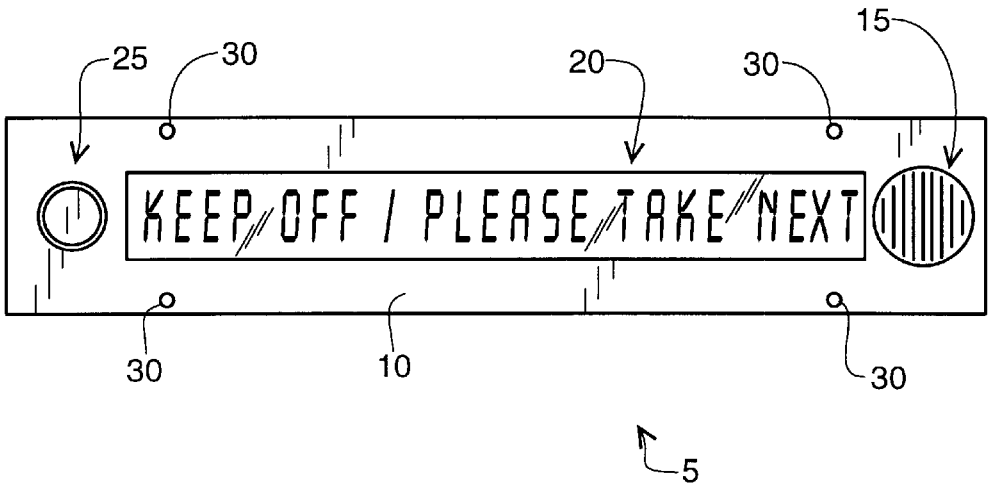
FIG. 1 is a front elevational view of an automatic door warning system of the present invention.

Referring now to FIG. 1, an automatic door warning system 5 is shown. A front panel 10, contains a speaker 15, a message display area 20, and a visual warning means 25. The front panel 10 is provided with first circular openings 30 for installation using screws (not shown) or other known fasteners.

Figure 2:
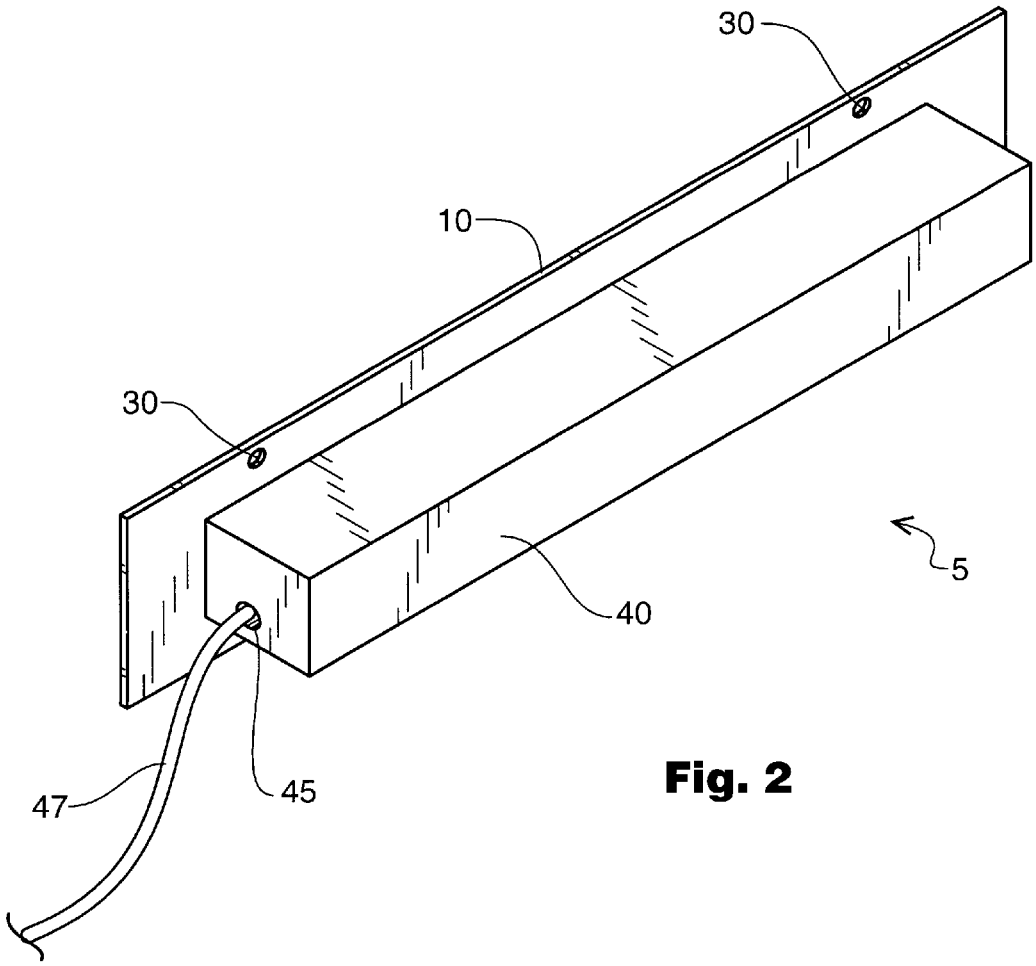
FIG. 2 is a rear perspective view of the automatic door warning system.

Referring to FIG. 2, the automatic door warning system 5 is shown from a rear view. A rear housing 40 is shown in mechanical contact with the front panel 10. A second circular opening 45 is provided in the rear housing 40 for a power and control wiring harness 47, which will be described in greater detail below. The rear housing 40 and the front panel 10 in conjunction with the first circular openings 30 provide for recessed mounting of the automatic door warning system 5 in a manner that is well known to those skilled in the art.

Figure 3:
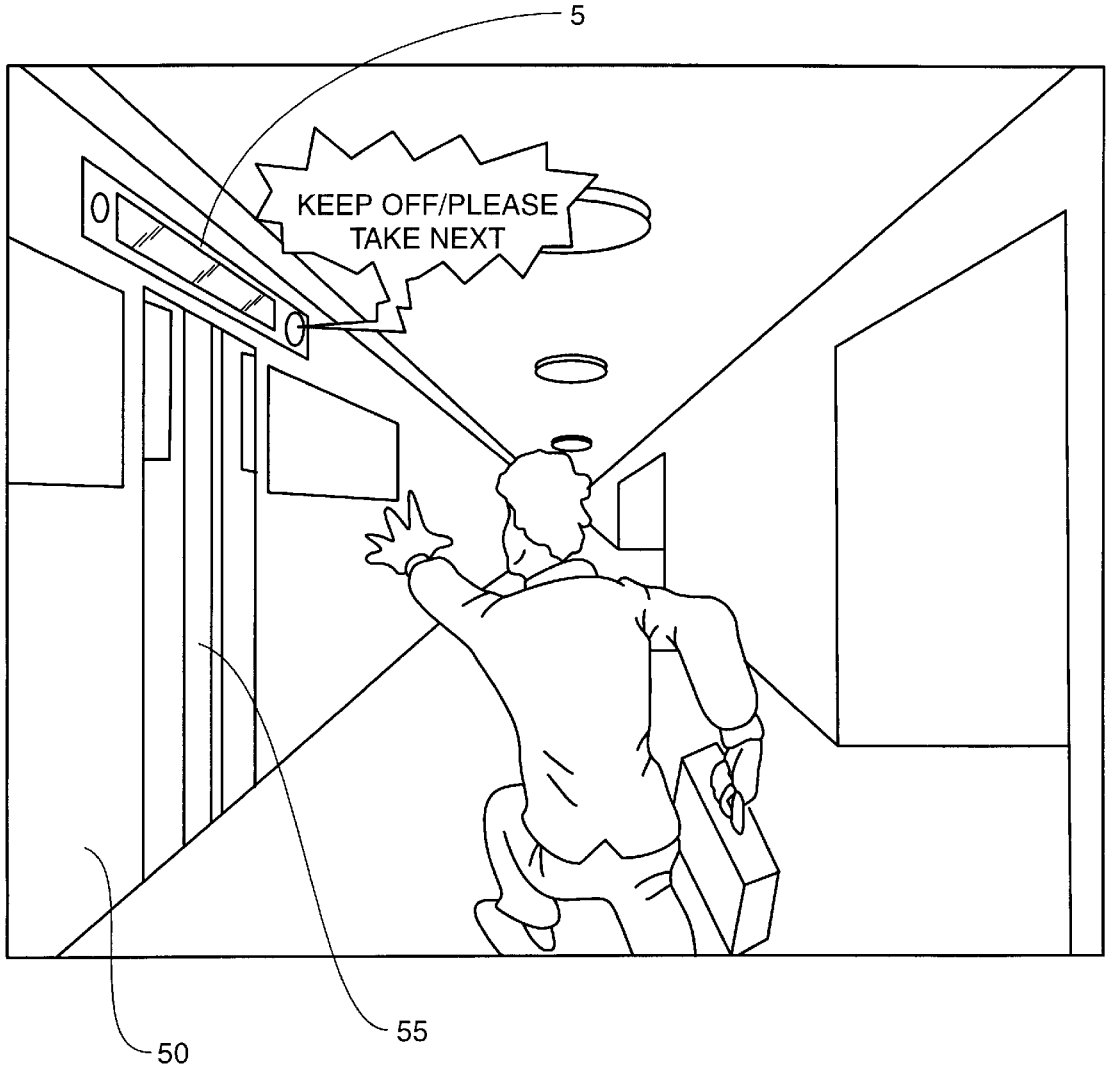
FIG. 3 is a one-point perspective illustration of the automatic door warning system in use on a public transportation system.

FIG. 3 shows the automatic door warning system 5 installed on a public transportation vehicle 50. The automatic door warning system 5 is installed directly above and in close physical proximity to an automatic door 55 of the public transportation vehicle 50. The rear housing 40 (shown in FIG. 2) and the power and control wiring 47 (shown in FIG. 2) are located in a recessed and concealed manner within the public transportation vehicle 50.

Figure 4:
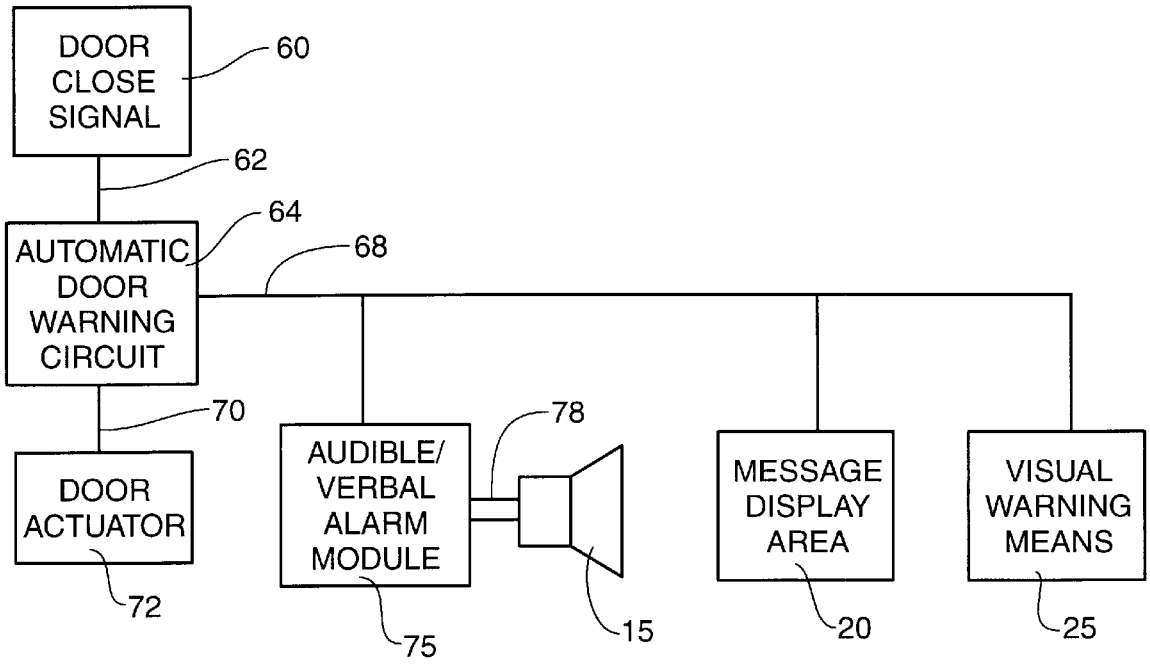
FIG. 4 is a functional block diagram of the automatic door warning system.

FIG. 4 is a functional block diagram of the automatic door warning system 5. A door close signal 60 is received from existing door control circuitry and an electrical signal 62 enables an automatic door warning circuit 64. An instantaneous output signal 68 and a delay output signal 70 is generated from the automatic door warning circuit 64. The delay output signal 70 energizes a door actuator 72 which is part of the existing automatic door mechanism. The instantaneous output signal 68 energizes an audible verbal alarm module 75, the message display area 20 and the visual warning means 25. The audible verbal alarm module 75 produces audible output in the speaker 15 through an analog waveform 78. The electrical signal 62 and the delay output signal 70 is contained within the power and control wiring harness 47 (shown in FIG. 2).

The message display area 20 is preferably an electronic display panel capable of being programmed with different messages which may include text and/or graphics, but may also consist of one message capable of being backlit at the appropriate time. The visual warning means 25 is preferably a flashing red strobe light, but may consist of many other different visual warning indicators familiar to those skilled in the art. The audible verbal alarm module 75 is preferably an electronic voice storage module capable of being programmed with different messages and/or warning sounds, but may also comprise a mechanical tape playback unit or an audible alarm module only.

In operation, the present invention provides an additional level of accident avoidance to the everyday user of public transportation in a clear and concise manner without any input or training on the part of the user. The operation of the present invention with its preferred embodiment can best be described in conjunction with the functional block diagram of an automatic door warning system as shown in FIG. 4.

Referring to FIG. 4, the door close signal 60 is received from existing door control circuitry, which is either an automatic signal as would be found on passenger elevators or an operator produced signal as would be found on transit buses. The door close signal 60, is utilized by automatic door warning circuit 64 to produce either the instantaneous output signal 68 or the delay output signal 70. The instantaneous output signal 68 is utilized to produce both audible and visual warnings that automatic door closure is imminent. These warnings are produced by the audible/verbal alarm module 75 and its associated speaker 15, the message display area 20 and the visual warning means 25. The audible/verbal alarm module 75 produces audible voice messages to warn of imminent door closure, alarm warning sounds to warn of imminent door closure, or a combination of both. After a suitable period of time on the order of three to five seconds, the audible and visual warnings cease and the delay output signal 70 energizes a door actuator 72 which is part of the existing automatic door mechanism. The automatic door warning system is intended as an additional safety element for public transportation passengers and would supplement any existing door safety systems such as limit switches, electric photocells, infra-red motion detectors and the like which would remain in place and operational.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

What is claimed is:

1. An automatic door warning system for use in conjunction with those public transportation vehicles having automatic doors, said automatic door warning system comprising:

a front panel;

message display means for visually displaying textual messages, said message display means affixed to said front panel;

audible alarm means for providing an audible alarm;

visual alarm means for providing a visual warning;

a rear housing for containing said audible alarm means and said visual alarm means, said rear housing being in mechanical contact with said front panel; and attachment means for affixing said automatic door warning system to a surface.

2. The automatic door warning system as described in claim 1, wherein said message display means comprises a message display area mounted to said front panel, said message display area having an electronic, programmable display panel capable of being programmed for a plurality of messages.

3. The automatic door warning system as described in claim 1, wherein said audible alarm means comprises:

a programmable audible and verbal alarm module for producing an electronic output in an analog waveform emulating verbal commands; and a speaker unit for projecting said electronic output.

4. The automatic door warning system as described in claim 1, wherein said visual alarm means comprises a flashing strobe light.

5. A door warning system for use with automatic doors having door control circuitry generating a door close signal and a door actuator, said door warning system comprising:

door close signal means for receiving an electrical door close signal from existing door control circuitry;

an automatic door warning circuit both for receiving said door close signal and for generating a delay output signal to actuate said door actuator and an instantaneous output signal;

a speaker;

an audible verbal alarm module activatable by said instantaneous output signal, said audible verbal alarm module for generating sounds and words through said speaker;

a message display area activated by said instantaneous output signal, said message display area capable of displaying a textual message; and visual warning means activated by said instantaneous output signal for providing visual alarm indications.

6. The door warning system as described in claim 5, wherein said message display area comprises a programmable display panel capable of being programmed to generate a plurality of messages.

7. The door warning system as described in claim 5, wherein said visual warning means comprises a flashing strobe light.

* * * * *

US005986561C1

(12) EX PARTE REEXAMINATION CERTIFICATE (8878th)

United States Patent
Kuruvilla et al.

(10) Number: US 5,986,561 C1
(45) Certificate Issued: Mar. 6, 2012

(54) AUTOMATIC DOOR WARNING SYSTEM

(75) Inventors: Kolanparampil K. Kuruvilla, Lansdale, PA (US); Santhamma Kuruvilla, Lansdale, PA (US)

(73) Assignee: Wayne County Airport Authority, Detroit, MI (US)

Reexamination Request:
No. 90/009,895, May 12, 2011

Reexamination Certificate for:

| | |
|---|---|
| Patent No.: | **5,986,561** |
| Issued: | **Nov. 16, 1999** |
| Appl. No.: | **09/093,197** |
| Filed: | **Jun. 6, 1998** |

(51) Int. Cl.
*G08B 7/00* (2006.01)
*G08B 7/06* (2006.01)

(52) U.S. Cl. ..... 340/691.5; 340/326; 340/679; 340/691.4; 340/691.6; 340/692; 340/693.5; 340/693.9

(58) Field of Classification Search ..... None
See application file for complete search history.

(56) References Cited

To view the complete listing of prior art documents cited during the proceeding for Reexamination Control Number 90/009,895, please refer to the USPTO's public Patent Application Information Retrieval (PAIR) system under the Display References tab.

*Primary Examiner*—Lynne H Browne

(57) ABSTRACT

An apparatus is provided for the automatic advance warning of imminent automatic door closure to passengers of public transportation vehicles. Comprised of a panel mounted above the automatic door, comprising an alarm light, a message display area, and a speaker capable of producing audible alarm warnings as well as audible verbal warning messages, it is capable of warning incoming passengers that automatic door closure is imminent. When a door close signal is received from existing door control circuitry, the apparatus is activated and it produces the audible and visual warning messages. After an appropriate delay period the audible and visual warning devices are deactivated and a door close signal is issued to the existing automatic doors and associated door safety guard circuitry.

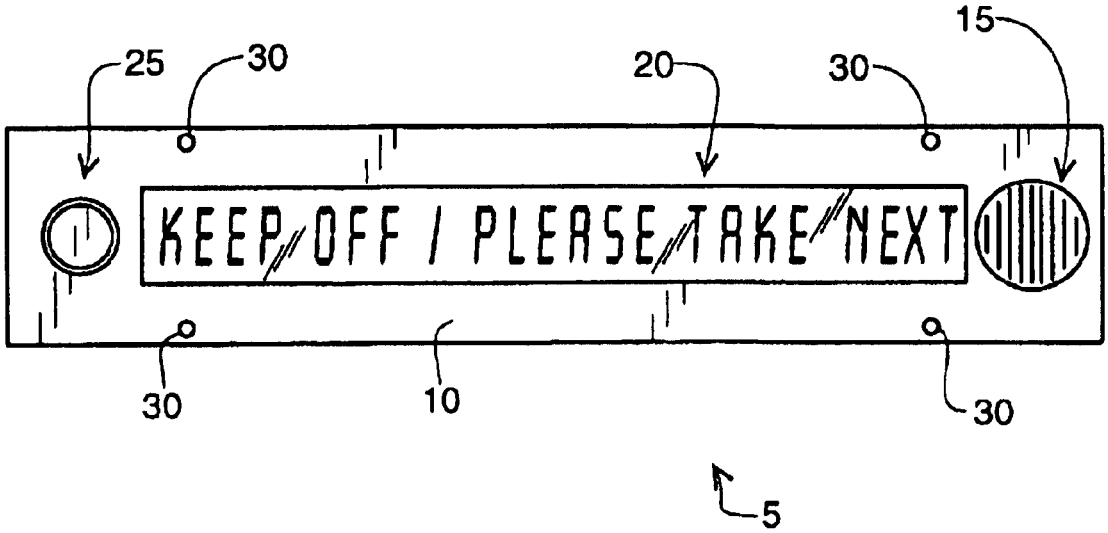

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *